US006076539A

United States Patent [19]

Richardson

[11] Patent Number: 6,076,539

[45] Date of Patent: Jun. 20, 2000

[54] BACKPACKER'S ADJUSTABLE SHIELD

[76] Inventor: Fletcher W. Richardson, 28023 SE. 231st St., Maple Valley, Wash. 98038

[21] Appl. No.: 09/132,932

[22] Filed: Aug. 11, 1998

Related U.S. Application Data

[60] Provisional application No. 60/056,318, Aug. 14, 1997.

[51] Int. Cl.[7] ..... A45B 11/02

[52] U.S. Cl. ..... 135/20.1; 135/96; 135/120.3; 224/190

[58] Field of Search ..... 135/19.5, 20.1, 135/21, 27, 33.7, 37, 96, 120.3, 120.4, 125, 126; 224/186–190

[56] References Cited

U.S. PATENT DOCUMENTS

| | | | |
|---|---|---|---|
| 171,967 | 1/1876 | Arnold | 135/21 X |
| 616,903 | 1/1899 | Crocker | 135/96 X |
| 1,460,821 | 7/1923 | Morris | 135/16 |
| 1,627,847 | 5/1927 | Harold . | |
| 3,840,161 | 10/1974 | Boggs et al. . | |
| 4,112,957 | 9/1978 | Biven . | |
| 4,170,242 | 10/1979 | Caso . | |
| 4,179,053 | 12/1979 | Figura . | |
| 4,188,965 | 2/1980 | Morman . | |
| 4,203,457 | 5/1980 | Friedman et al. . | |
| 4,312,371 | 1/1982 | Koon | 135/20.1 X |

FOREIGN PATENT DOCUMENTS

| | | | |
|---|---|---|---|
| 237718 | 2/1962 | Australia | 135/16 |

*Primary Examiner*—Richard Chilcot
*Attorney, Agent, or Firm*—Dean A. Craine

[57] ABSTRACT

The shield includes a main, forward extending canopy having flexible, curved, front supported edges. The canopy is sufficient in size to act as a sun or rain shield for the user. The outer supported edge is designed to bend inward, downward, or upward when in contact with trees or bushes while hiking. Integrally formed along the rear portion of the canopy is a rear cover which is designed to extend rearward and partially cover the top portion of the backpack. A vertical support is provided which holds the canopy in an elevated position above the user's head and shoulders. The vertical support may be attached to a backpack or to a waist belt or chest harness. Hook and loop strap connectors are used to selectively attach the vertical support to frame members on a typical backpack. Also included are two pitch control straps located on opposite sides of the canopy which enable the user to adjust the pitch of the canopy to improve visibility and the amount of shade. An elastic strap is adjustably attached to each pitch control strap to hold the canopy in a desired pitch over the hiker.

4 Claims, 3 Drawing Sheets

BACKPACKER'S ADJUSTABLE SHIELD

This is a utility patent application based on a provisional patent application filed Aug. 14, 1997, (Ser. No. 60/056, 318).

BACKGROUND OF THE INVENTION

1. Field of the Invention

This invention relates to sun and rain covers or shields and, more particulary, to covers or shields capable of being used by a backpacker while hiking.

2. Description of the Related Art

While hiking, it is sometimes desirable to shield the hiker's head and shoulders from the sun or rain. In order to provide adequate protection, the shield must be sufficiently large to extend over the hiker's head and shoulders. Since hikers also carry backpacks, the shield also must be capable of being used with a backpack.

One problem with using an above-the-head, forward projecting shield is that they often obscure the hiker's forward vision. This is a critical problem when the hiker is climbing up steep terrain. Another problem with using an above-the-head shield is that shrubs and tree branches may come in contact with the shield when hiking and damage it or dislodge it. Still another problem with using a shield, is assembling and disassembling the shield and then storing it in a convenient, compact location in the backpack.

SUMMARY OF THE INVENTION

It is an object of the present invention to provide a sun or rain shield for a hiker to protect the hiker's head and shoulders during use.

It is another object of the present invention to provide such a shield that can be used with a backpack.

It is a further object of the present invention to provide such a shield that is adjustable relative to the hiker's field of vision and capable of protecting the top portion of the backpack.

It is a still further object of the present invention to provide such a shield that is easily attachable and removable, and is sufficiently durable to be used in the wilderness.

These and other objects are met by providing a shield designed to cover the hiker's head and shoulders and the top portion of a backpack when carried by the hiker. The shield includes a forward extending canopy that extends sufficiently forward to protect the hiker's head and front torso. The canopy is supported over the hiker by a vertical support which adjustably attaches either to frame members on a backpack or to a waist belt or chest harness. A connecting means is provided for attaching the canopy to the upper portion of the vertical support. The pitch of the canopy is adjustably controlled by pitch control means disposed between the canopy and the vertical support. In the embodiment disclosed herein, the pitch control means are two pitch control straps located on opposite sides of the canopy. The opposite ends of each pitch control strap are spaced apart and securely attached to the outer supported edge on the canopy. Each pitch control strap is connected to an elastic strap which applies constant downward tension thereto. A slide connector is also included on each pitch control strap which connects to one end of the elastic strap. During use, the hiker is able to adjust the location of the slide connector on the pitch control strap thereby enabling the hiker to adjust the relative pitch of the canopy. In one embodiment, one continuous elastic strap is used which connects to one slide connector, extends through the lower opening of one leg on the vertical support, through the upper portion of the vertical support, through the lower opening on the opposite leg, and then connects to the opposite slide connector.

The canopy itself is made of durable nylon material with a flexible, outer supported edge. The outer supported edge is designed to maintain its forward extending, curved shape during use yet sufficiently flexible to bend inward, downward, or upward when in contact with shrubs and tree branches.

Integrally formed along the rear portion of the canopy is a rear cover which extends rearward from the vertical support to partially cover the hiker's shoulders and top portion of the backpack. An optional elastic strap is also provided for drawing the rear edge of the rear cover tightly around the backpack.

DESCRIPTION OF THE PREFERRED EMBODIMENT(S)

Figure 1:
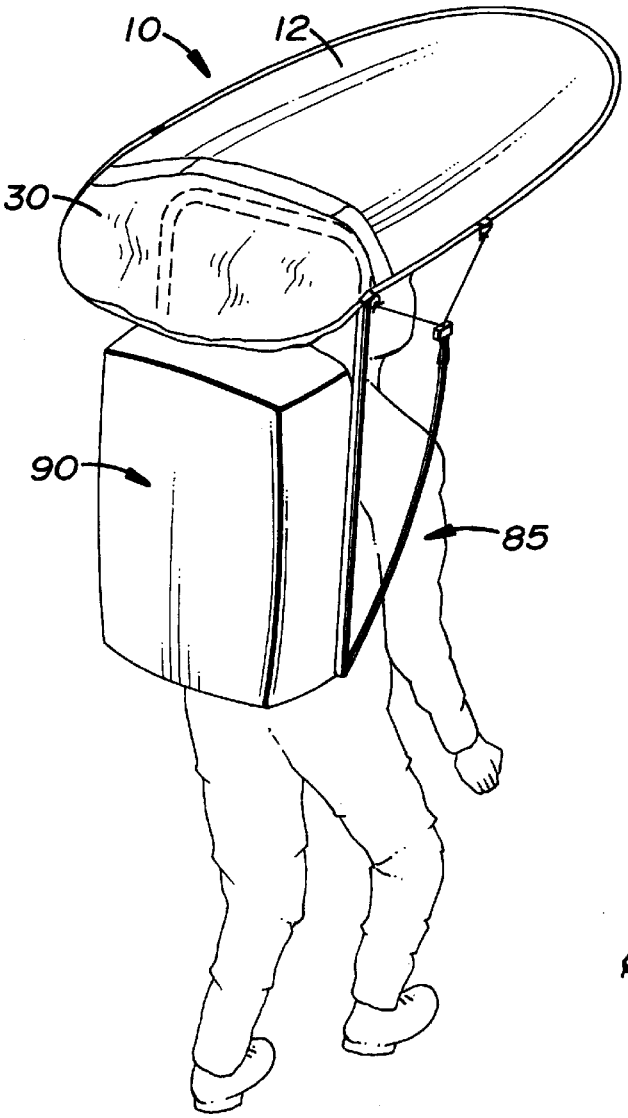
FIG. 1 is a perspective view of the adjustable backpack shield attached to a backpack and worn by a hiker.
Figure 5:
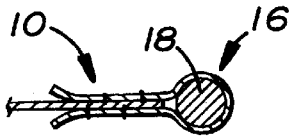
FIG. 5 is a sectional, side elevational view of the front edge of the canopy taken along line 5—5.

As shown in the accompanying FIGS. 1–7, wherein like reference numbers denote like structures, there is shown a lightweight shield 10 designed to cover the hiker's head and shoulders and top portion of a backpack. In the embodiment shown, the shield 10 includes a forward extending canopy 12 that extends sufficiently forward to protect the hiker's head and front portion of the body. The canopy 12 is made of nylon material and extends in a forward direction in front of the hiker's head approximately twenty-four inches and in a lateral direction from the mid-line axis approximately twelve inches. The canopy 12 includes a flexible, outer supported edge 16 as shown in FIG. 5. During manufacturing, a continuous passageway 17 is formed along the perimeter of the canopy 12 and a flexible rod 18 is inserted therein. The flexible rod 18 is made of nylon or plastic approximately one-eighth of an inch in diameter and is sufficiently rigid yet flexible so that the canopy 12 maintains its shaped yet allows the canopy 12 to flex upward or downward when in contact with shrubs or tree branches.

Attached to the rear edge of the canopy 12 is an optional rear cover 30 which extends rearward to cover a backpack carried by the user. During manufacturing, the canopy 12 and rear cover 30 are attached together along a seam 30 created between the adjoining edges of the canopy 12 and the year cover 30.

Figure 3:
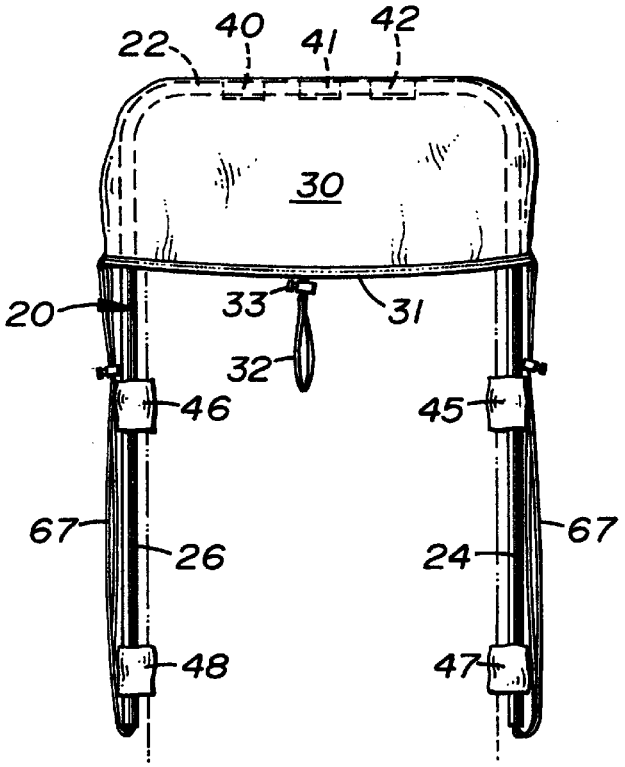
FIG. 3 is a rear elevational view take along line 3—3 in FIG. 2.
Figure 4:
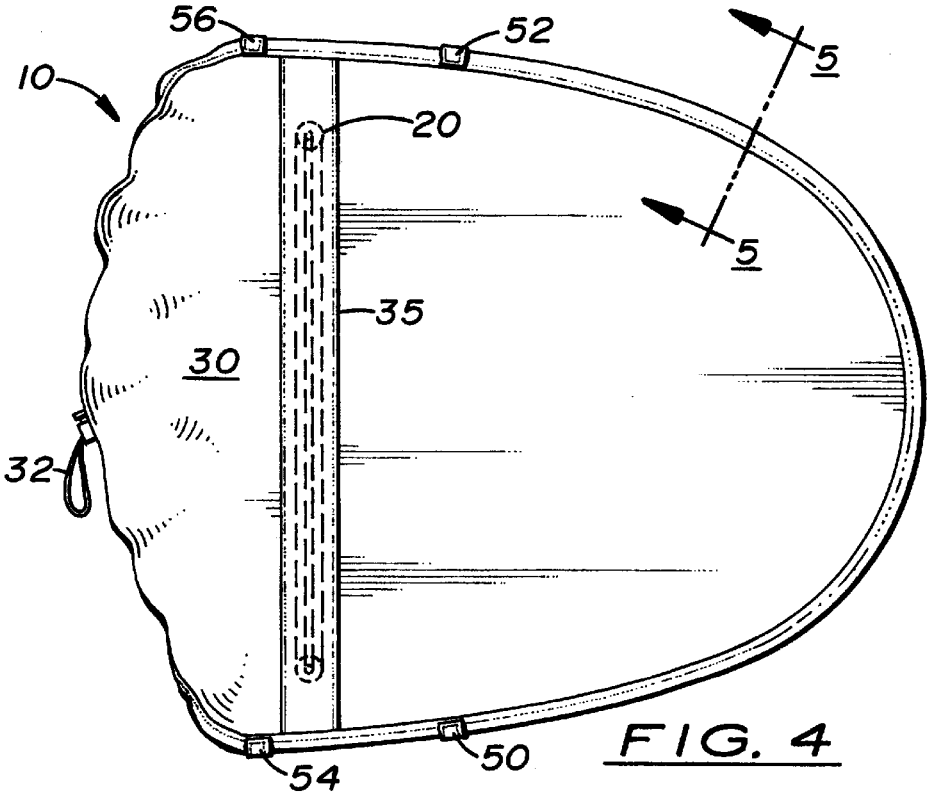
FIG. 4 is a top plan view of the invention.
Figure 6:
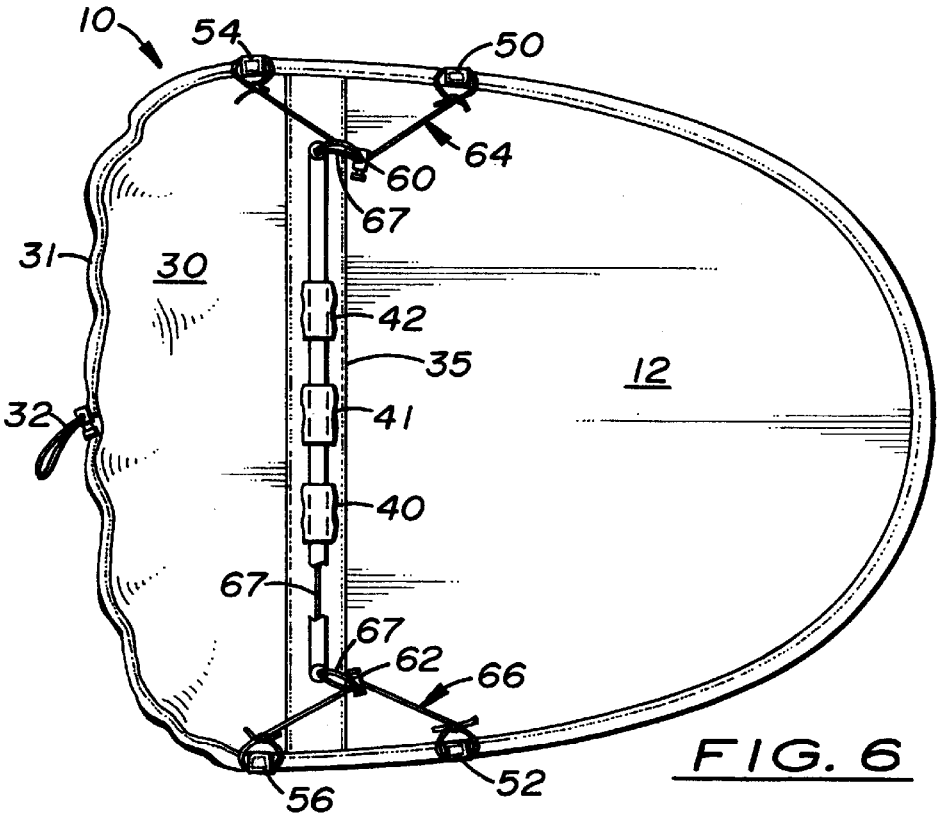
FIG. 6 is a bottom plan view of the invention.

The shield 10 is supported over the hiker 85 by a vertical support 20 which adjustably attaches to the frame members 92 on a typical backpack 90. The vertical support 20, shown more clearly in FIG. 3, is an upside-down "u" shaped structure having an upper portion 22, a right leg 24, and a left leg 26. The vertical support 20 is hollow and made of lightweight, relatively stiff material, such as aluminum or carbide. An optional connecting means is provided for attaching the canopy 12 to the upper portion 22 of the vertical support 20. As shown in FIGS. 3 and 6, the connecting means includes three hook and loop strap connectors, 40, 41, 42, which wrap around the upper portion 22 of the vertical support 20, and attached to the inside surface of the canopy 12.

Figure 7:
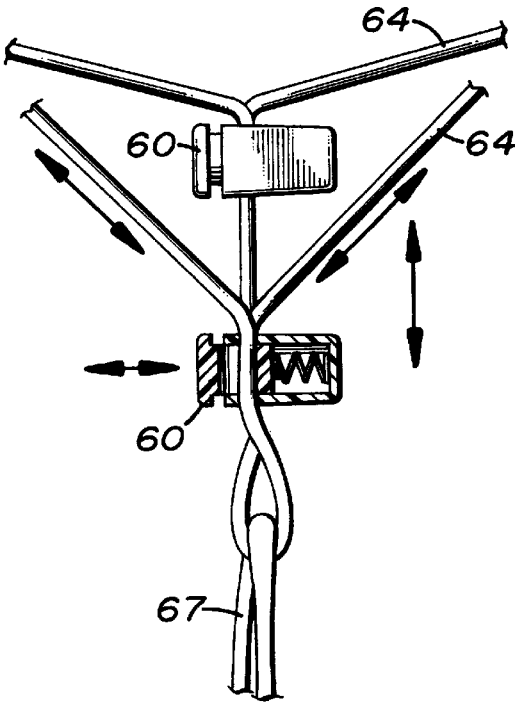
FIG. 7 is a side elevational view of the adjustment straps.
Figure 2:
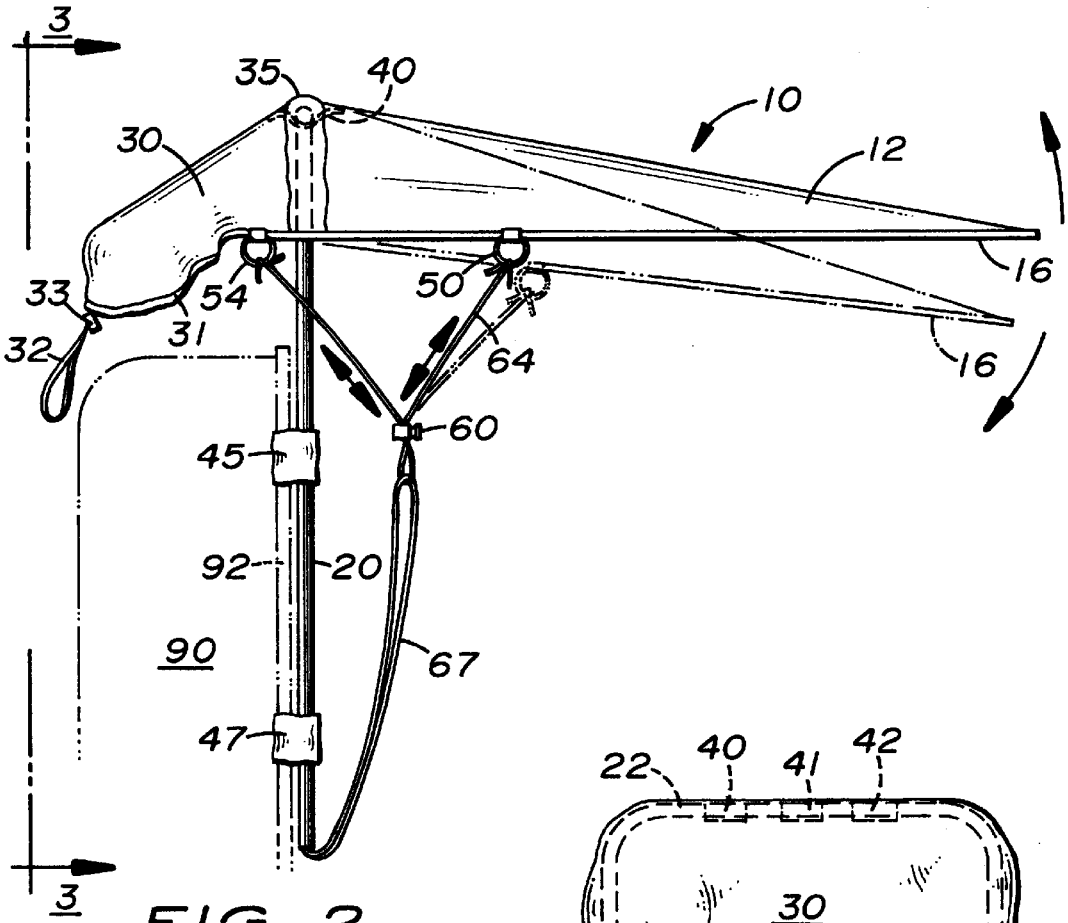
FIG. 2 is a side elevational view of the invention showing the pitch of the canopy being adjusted by the slide connector on the pitch control strap.

The pitch of the canopy 12 is adjustably controlled by two pitch control straps 64, 66 located on the opposite sides of the canopy 12. In the embodiment disclosed herein, the two pitch control straps 64, 66 are connected together by an elastic strap 67 which extends through the lower opening on right leg 24 through the upper portion 22, and through the lower opening on the opposite left leg 26 on the vertical support 20. During use, the elastic strap 67 applies constant tension on the two pitch control straps 64, 66 to keep the canopy 12 forced downward on the vertical support 20. It should be understood, however, that the elastic strap 67 could be replaced with two single elastic straps (not shown) connected between a slide connector and one leg on the vertical support. The opposite ends of each pitch control strap 64, 66 are attached to two, spaced-apart connecting points located along the outer supported edge 16 of the canopy 12. Each pitch control strap 64, 66 also includes a longitudinally adjustable slide connector 60, 62, respectively. The slide connectors 60, 62 move longitudinally along each pitch control strap 64, 66, respectively, enabling the hiker to adjust the location of the connecting point of the end of the elastic strap 67 so that the lengths of the two legs of the pitch control straps 64, 66 between the connecting points and the slide connector 60, 62 may be adjusted, as shown in FIG. 7. By adjusting the position of the slide connector 60, 62 along the pitch control straps, 64, 66, the hiker is able to adjust the relative pitch of the canopy 12 to alter the forward field of view, as shown in FIG. 2.

In compliance with the statute, the invention, described herein, has been described in language more or less specific as to structural features. It should be understood, however, the invention is not limited to the specific features shown, since the means and construction shown comprised only the preferred embodiments for putting the invention into effect. The invention is, therefore, claimed in any of its forms or modifications within the legitimate and valid scope of the amended claims, appropriately interpreted in accordance with the doctrine of equivalents.

What is claimed is:

1. A backpacker's adjustable shield, comprising:

a. a canopy, said canopy having an outer supported edge, said outer supported edge includes a flexible rod attached along the periphery of said canopy;

b. an inverted, u-shaped vertical support having a left leg, a right leg, and an upper section;

c. a connecting means for connecting said canopy to said vertical support; and, d. a pitch control means disposed between said canopy and said vertical support capable of adjustably controlling the pitch of said canopy relative to said vertical support, said pitch control means includes at least one pitch control strap attached at its opposite ends to two-spaced apart points on said outer supported edge and an elastic strap disposed between said vertical support and said pitch control strap, said elastic strap capable of applying a downward force on said pitch control strap, said elastic strap being adjustably connected along said pitch control strap to selectively control the pitch of said canopy.

2. A backpacker's adjustable shield, as recited in claim 1, wherein said connecting means is at least one hook and loop connector disposed on said canopy and said vertical support capable of holding said canopy on said vertical support.

3. A backpacker's adjustable shield, as recited in claim 1, wherein said front support edge includes a continuous passageway formed along the periphery of said canopy through which said flexible rod may be inserted.

4. A backpacker's adjustable shield, as recited in claim 1, wherein said elastic strap connects at one end to one said pitch control strap, extends downward and into said left leg, said upper section, said right leg and upward to said opposite control strap.

* * * * *